US007468128B2

(12) United States Patent
Clukies

(10) Patent No.: US 7,468,128 B2
(45) Date of Patent: Dec. 23, 2008

(54) BILGE WATER BARRIER AND POLLUTION PREVENTION SYSTEM

(75) Inventor: Paul Arthur Clukies, Highlands Ranch, CO (US)

(73) Assignee: Paul Arthur Clukies, Highlands Ranch, CO (US)

( * ) Notice: Subject to any disclaimer, the term of this patent is extended or adjusted under 35 U.S.C. 154(b) by 405 days.

(21) Appl. No.: 11/305,680

(22) Filed: Dec. 16, 2005

(65) Prior Publication Data

US 2007/0138080 A1 Jun. 21, 2007

(51) Int. Cl.
*B01D 33/82* (2006.01)

(52) U.S. Cl. ..... 210/104; 210/121; 210/122

(58) Field of Classification Search ..... 210/104, 210/121–122

See application file for complete search history.

(56) References Cited

U.S. PATENT DOCUMENTS

| | | | | |
|---|---|---|---|---|
| 3,537,587 | A | 11/1970 | Kain | 210/242 |
| 3,679,058 | A | 7/1972 | Smith | 210/242 |
| 3,702,657 | A | 11/1972 | Cunningham et al. | 210/242 |
| 3,739,913 | A | 6/1973 | Bogosian | 210/242 |
| 3,836,000 | A * | 9/1974 | Jakubek | 210/104 |
| 3,888,766 | A | 6/1975 | De Young | 210/36 |
| 3,960,719 | A | 6/1976 | Bresson | 210/23 |
| 3,976,570 | A | 8/1976 | McCray | 210/30 |
| 3,996,136 | A | 12/1976 | Jakubek et al. | 210/86 |
| 4,031,839 | A | 6/1977 | Pedone | 114/270 |
| 4,130,489 | A | 12/1978 | Black | 210/242.4 |
| 4,784,773 | A | 11/1988 | Sandberg | 210/691 |
| 4,915,823 | A | 4/1990 | Hall | 210/95 |
| 4,981,097 | A | 1/1991 | Beyrouty | 114/228 |
| 5,186,831 | A | 2/1993 | DePetris | 210/242.4 |
| 5,227,072 | A | 7/1993 | Brinkley | 210/671 |
| 5,458,773 | A | 10/1995 | Holland | 210/282 |
| 5,730,868 | A | 3/1998 | Cordani | 210/242.4 |
| 5,948,266 | A | 9/1999 | Gore et al. | 210/693 |
| 6,235,201 | B1 | 5/2001 | Smith et al. | 210/691 |
| 6,398,966 | B1 | 6/2002 | Smith et al. | 210/691 |
| 6,409,924 | B1 | 6/2002 | Johnson | 210/691 |
| 6,712,957 | B2 | 3/2004 | Papke | 210/112 |
| 7,138,055 | B2 | 11/2006 | Clukies | |

* cited by examiner

*Primary Examiner*—Chester T Barry
(74) *Attorney, Agent, or Firm*—Marsh Fischmann & Breyfogle LLP

(57) ABSTRACT

A fluid pollution prevention system for preventing the discharge of hazardous waste from a bilge of a marine vessel. The system includes an continuous sidewall that defines a vertically enclosed volume. When positioned within a bilge, the sidewall forms a barrier to petrochemicals floating on a fluid surface within the bilge. An opening near a base of the sidewall permits fluid from beneath the fluid surface to enter the vertically enclosed volume. Such fluid is substantially free of petrochemicals and may be removed form the vertically enclosed volume. Accordingly, by pumping fluid out of the enclosed volume, fluid may be removed form the bilge substantially free of petrochemicals. In one arrangement, the vertically enclosed volume may be sized to receive a bilge pump.

26 Claims, 8 Drawing Sheets

BILGE WATER BARRIER AND POLLUTION PREVENTION SYSTEM

FIELD

The invention is related to the field of water pollution prevention, and in particular, to preventing the discharge of hazardous waste fluids from the bilge of a marine vessel.

BACKGROUND

By design, substantially all potential fluid containment areas of a marine vessel, e.g., all types of engine-powered boats, ships, offshore drilling platforms, etc. drain toward a common collecting area known as a bilge. The bilge is typically located in a lower or bottom portion of a vessel and includes a pump. The pump is referred to in the art as a bilge pump, and upon accumulation of a predetermined amount of fluid in the bilge, the bilge pump is designed to pump the collected fluid overboard of the vessel.

An automatic switch activated by a float ("float switch") or by the electrical connection of contact points by fluid within the bilge, controls operation of the bilge pump. The automatic switch functions to start and stop the pump according to the level of fluid contained in the bilge. The switch is electrically connected to the bilge pump such that as fluid accumulates in the bilge, and the fluid level raises, the switch is triggered to initiate operation of the pump, and begin pumping the fluid overboard. Similarly, as the fluid is pumped overboard and the fluid level in the bilge falls to a predetermined level, the switch terminates operation of the pump.

Due to the location of the bilge in the bottom of a vessel, hazardous waste, such as oil, gasoline, diesel fuel, grease, transmission fluid etc., are also subject to collection in the bilge along with non-hazardous fluids such as rainwater, air conditioner condensate, and water brought onto the vessel due to seepage, swimming and/or other activities. These hazardous waste fluids, if not removed prior to operation of the bilge pump, are discharged overboard with the other fluids, thereby polluting the surrounding waterway. Additionally, under current laws, the discharge of such hazardous waste fluids into a waterway is a source of liability for owners and operators of marine vessels. Therefore, a need exists in the art for preventing the discharge, as well as removal of, hazardous fluids from marine vessels.

SUMMARY

In view of the foregoing, one objective is to minimize or eliminate the introduction of hazardous fluids to an inlet of a bilge pump of a marine vessel and thereby prevent discharge of such hazardous fluids into a waterway. As set forth herein, the term "marine vessel" includes any structure having a collection area, e.g., a bilge, for disposal of fluids into a waterway, with some examples including without limitation, all types of engine-powered boats, ships, offshore drilling platforms and the like, etc. Also, as set forth herein hazardous waste fluids are referred to as petrochemicals and include at least hydrocarbon compounds such as crude oil, diesel fuel, gasoline, transmission oil, gear oil and the like.

As is well known, petrochemicals and water do not mix due to the density difference and buoyancy forces therebetween. Rather, petrochemicals float on the surface of water in a separate buoyant layer. The inventor has recognized that this natural separation of petrochemicals and water may be utilized advantageously to isolate petrochemicals from an inlet of a bilge pump. Specifically, by providing a barrier to isolate a fluid volume within the bilge from petrochemicals floating on the surface of fluid within the bilge, fluid from the isolated volume may be pumped out of the bilge substantially free of the floating petrochemicals. This approach may be compared and contrasted as unique to other methods and devices that attempt to address the same problem of preventing the discharge of hazardous fluids from the bilge of a marine vessel. One example is the currently available post-bilge pump in-line filters that attempt to treat an emulsion of oil and water as it passes from the bilge pump discharge port on its way out of the vessel. Accordingly, various apparatuses are disclosed herein for use in a system for isolating a bilge fluid volume from floating petrochemicals and pumping fluid from that isolated volume.

According to a first aspect, an apparatus for isolating petrochemicals in a bilge is provided that includes a base member for attachment to a surface of a bilge and a continuous sidewall interconnected to the base member. The continuous sidewall defines a vertically enclosed volume between a top edge and a bottom edge. In this regard, the sidewall forms a vertical barrier to petrochemicals floating on a fluid surface when the fluid surface is between the top edge and the bottom edge of the sidewall. The apparatus further includes at least one opening between the base member and the bottom edge of the sidewall that permits fluid to be introduced into the enclosed volume. More specifically, the opening allows fluid to be introduced into the enclosed volume from beneath a fluid surface when that fluid surface is between the top edge and the bottom edge of the sidewall.

Various refinements exist of the features noted in relation to the subject aspect. Further features may also be incorporated into the subject aspect as well. These refinements and additional features may exist individually or in any combination. For instance, the sidewall may define any closed geometric shape that includes an internal area, which may be sized for a particular purpose. Non-limiting examples of closed geometric shapes that may be utilized include: round, elliptical, regular polygonal, irregular polygonal and irregular shapes. The size of the internal area defined by the continuous sidewall may be sized to provide an enclosed volume (e.g., between the top and bottom edges) that is adapted to receive at least a portion or all of a bilge pump therein. In this regard, a bilge pump may be disposed within the enclosed volume to pump fluid out of the enclosed volume substantially free of petrochemicals. Further, a cap member may be disposed over a portion or all of the enclosed volume to prevent petrochemicals from splashing over the top edge of the sidewall and thereby entering the vertically enclosed volume.

In a further arrangement, the present aspect may also utilize a floating petrochemical absorber to further isolate the enclosed volume from petrochemicals. The floating petrochemical absorber may be operative to move in relation to a level of fluid within the bilge in conjunction with absorbing petrochemicals floating on the surface of the fluid. Such an absorber may be disposed about a portion or the entirety of the continuous sidewall and thereby at least assist in the isolation of the vertically enclosed volume from floating petrochemicals. In one arrangement, the petrochemical absorber may define a closed geometric shape having an internal area sized for disposition about the continuous sidewall. In any arrangement, the sidewall may be utilized to maintain a lateral position of the absorber and/or define a path of travel for the absorber.

In one arrangement, the apparatus further includes a lip interconnected to at least a portion of the sidewall and extending outwardly relative to the vertically enclosed volume. This lip is operative to limit upward movement of a floating petrochemical absorber that may be disposed about at least a portion of the sidewall. Such a lip may be removably connected or positioned to the sidewall such that a floating petrochemical absorber disposed about the sidewall may be removed from the apparatus. Further, the lip may be continuous around the periphery of the sidewall or formed of a plurality of segmented portions. What is important is that the lip is operative to limit vertical movement of a floating petrochemical absorber. Further, an outside surface of the sidewall between the top edge and the bottom edge may be substantially vertical. This may permit a floating absorber disposed around at least a portion of the sidewall to move relative to the sidewall as a function of a level of fluid within the bilge.

The opening between the base member and the bottom edge of the sidewall permits fluid beneath the surface of fluid in a bilge to enter into the vertically enclosed volume free of petrochemicals floating on top of the fluid surface. In one arrangement, a plurality of such openings are disposed between the base member and the bottom edge of the sidewall. In a further embodiment, these openings are sized to prevent debris of a predetermined size from entering into the vertically enclosed volume. In another arrangement, the maximum height of these openings is no greater than the thickness of a floating absorber utilized with the apparatus. In another arrangement, the maximum height of the openings is no greater than one-half of the thickness of the floating absorber. As may be appreciated, by utilizing an absorber with a thickness in excess of the maximum height of the openings, the absorber may be operative to prevent entry of petrochemicals into the vertically enclosed volume when a fluid surface level is below the bottom edge of the sidewall.

The base member may be any member that permits attachment of the apparatus within a bilge. For instance, the base member may include one or more mounting brackets interconnected to the continuous sidewall. Alternatively, the base member may be a plate member disposed substantially perpendicular to the sidewall. Such a plate member may form a floor of the enclosed volume.

In another arrangement, the apparatus includes a fluid conduit having an inlet supportably positioned within the sidewall and an outlet extending out of the sidewall. This outlet may be fluidly connected to the inlet of a bilge pump. In such an arrangement the apparatus does not house a bilge pump but rather houses an inlet that is connectable to a bilge pump mounted at another location within the vessel. The inlet of the fluid conduit may be disposed between the top and bottom edges of the sidewall. Further, the inlet of the conduit may be selectively positionable relative to the sidewall. In a further arrangement, a cap member extends over an area defined by the annular sidewall. In this arrangement, the fluid conduit may pass through the cap member, which may at least in part support the fluid conduit.

According to another aspect, an apparatus to isolate petrochemicals from a fluid volume within the bilge of a marine vessel is provided. The apparatus includes a base for attachment relative to a surface of the bilge and a continuous sidewall extending upward from the base that defines an enclosed area. The sidewall includes a solid peripheral section between a first sidewall height as measured from the base and a second sidewall height as measured from the base, where the second sidewall height is greater than the first sidewall height. Further, the apparatus includes at least one opening extending through the sidewall at a location between the base and the first sidewall height. This opening is operative to permit fluid into the closed area.

The sidewall defines a barrier between the first and second sidewall heights that prevents petrochemicals floating on the surface of a fluid from entering the enclosed area defined by the sidewall when the level of that fluid is between the first and second sidewall heights. Likewise, the at least one opening permits fluid to be introduced into the enclosed area defined by the sidewall from beneath a fluid surface when that fluid surface is disposed between the first and second sidewall height.

According to another aspect of the invention, a method for isolating petrochemicals from a fluid volume within a bilge is provided. The method includes disposing a continuous sidewall within a bilge where the sidewall defines a vertically enclosed volume within the bilge. Fluid is drawn into the vertically enclosed volume through an opening in the sidewall disposed below a minimum fluid level in the bilge. Finally, the fluid may be removed from the vertically enclosed volume and removed from the bilge. The step of removing may include pumping fluid out of the vertically enclosed volume. In this regard, a pump may be disposed within the enclosed volume, or, fluid may be drawn out of the enclosed volume by the pump that is disposed outside of the enclosed volume.

Generally, the continuous sidewall may be disposed within the bilge such that it is at least partially transverse (e.g. Perpendicular) substantially to a waterline therein and/or upright relative to the bottom/floor of the bilge compartment. Generally, at least a portion of the sidewall extends above a maximum desired fluid height in the bilge. In this regard, the method may further include initiating the operation of a fluid pump upon a fluid level reaching the maximum desired fluid height. Likewise, the method may include deactivating such a pump when the water level reaches a lower fluid height and/or a minimum desired fluid height The method may further include absorbing petrochemicals floating on the surface of the fluid within the bilge. This may include absorbing petrochemicals floating on the surface of the fluid at a location that is proximate to an outside periphery of the sidewall. In one arrangement, this may entail moving a petrochemical absorber relative to the sidewall as a function of the level of fluid within the bilge. This may also entail restricting the vertical movement of the petrochemical absorber to a predetermined maximum height and/or maintaining a lateral position of a petrochemical absorber relative to an outside surface of the sidewall.

According to another aspect of the invention, a method for isolating a fluid volume within a bilge of a marine vessel is provided. The method includes isolating a vertical volume of bilge fluid within a bilge utilizing a continuous sidewall. Fluid is drawn into the vertical volume through an opening in the sidewall while preventing debris of a predetermined size from entering into the vertical volume through the opening. The bilge liquid may then be drawn out of the volume through an inlet of a fluid conduit that is supportably positioned within the volume above a maximum sidewall of the sidewall opening.

According to another aspect of the invention, an apparatus is provided for removing fluid from a bilge of a marine vessel substantially free of petrochemicals. The device includes a fluid conduit having an inlet end and an outlet end wherein the outlet end is fluidly connectable to an inlet of a bilge pump. Of note, the pump may be located at a location outside of the bilge and/or out of the bilge fluid. The apparatus further includes a conduit locator for supporting an inlet end of the fluid conduit in a predetermined orientation relative to a volume of fluid within the bilge of the marine vessel where the volume of fluid is substantially isolated from petrochemicals floating on a fluid surface within the bilge.

The isolated volume may be at least partially defined by either or both a floating petrochemical absorber and/or a sidewall that is disposable at least partially transverse to fluid within the bilge. What is important is that the absorber and/or sidewall prevent floating petrochemicals from entering a surface area associated with the isolated volume. Such an isolated surface area may at least partially define the isolated volume. For instance, the isolated volume may be defined by the periphery of an isolated surface area as it extends between the surface of the fluid and a bottom surface of a bilge. In this regard, the isolated volume may be defined by a floating petrochemical absorber that defines an enclosed area. Alternatively, the isolated volume may be defined by a continuous sidewall that defines a vertically enclosed volume between first and second sidewall heights as measured from a base of the sidewall. Where a sidewall is utilized, the sidewall may further include at least one opening that is operative to permit fluid from beneath the surface of the bilge fluid to enter into the sidewall. Such an opening may be disposed near the base of the sidewall.

The conduit locator may be any member that is operative to support the fluid conduit relative to the isolated fluid volume. In this regard, the conduit locator may include a bracket that is adapted to hold the fluid conduit relative to one or more structures within the bilge. In any case, it is preferable that the conduit locator be operative to position the inlet of the conduit to a location within the isolated volume. Further, the locator may hold the inlet such that is spaced from a periphery of the volume (e.g., toward a center of the isolated volume). Further, the conduit locator may be operative to adjust a height of the inlet of the fluid conduit, for example, relative to a bilge surface.

According to another aspect of the invention, an apparatus for isolating a fluid volume within a bilge of a marine vessel is provided. The apparatus includes a base for attachment relative to a surface of the bilge and a sidewall that is interconnected to the base that at least partially defines an enclosed volume. At least one sidewall opening extends through the sidewall that allows bilge fluid to be introduced into the enclosed volume. The apparatus further includes a fluid conduit having an inlet end and an outlet end. A support member supports the inlet end of the fluid conduit within the enclosed volume and the outlet end extends out of the enclosed volume and is fluidly connectable to the inlet of a pump.

In one arrangement, the apparatus further includes a floating petrochemical absorber that is disposed about at least a portion of the sidewall. In this arrangement, the sidewall and the absorber isolate the enclosed volume from floating petrochemicals. In this regard, the absorber may define an enclosed shape that isolates a surface area around to the sidewall from floating petrochemicals. Further, the sidewall may be continuous and include a solid peripheral section between a first sidewall height and a second sidewall height as measured from the base. In this regard, the sidewall may further and/or individually define a barrier to floating petrochemicals. In such an arrangement, the at least one sidewall opening may extend through the sidewall at a location proximate to the base. That is, at a location nearer to the base than the solid peripheral section. In such an arrangement, the inlet end of the fluid conduit may be located at a height above a maximum height of the sidewall openings.

Generally, it is desirable that the sidewall opening has an area that is at least as large as the inlet of the fluid conduit. In one arrangement, a plurality of openings are provided. This plurality of openings may have a combined area that is greater than the inlet area of the fluid conduit. Furthermore, the plurality of openings may each be sized to prevent entry of debris of a predetermined size into the enclosed volume.

The support member generally supports the inlet end of the fluid conduit at a location that is spaced from the periphery of the sidewall. The support member may further be adjustable such that height of the inlet end of the fluid conduit is selectively adjustable. In one arrangement, the support member is a cap member that extends over at least a portion of the enclosed volume. In this arrangement, the fluid conduit may extend through the cap member which may then be attached to at least portion of the sidewall.

According to another aspect of the present invention, a method for isolating petrochemicals from a fluid volume in the bilge of a marine vessel is provided. The method includes positioning an inlet of a fluid conduit within an isolated fluid volume. The isolated fluid volume is isolated from petrochemicals floating on a surface of fluid within a bilge. An outlet of the fluid conduit may be interconnected to a fluid pump. Once so connected, fluid may be drawn through the fluid conduit and discharged at a location outside of the bilge (i.e., into a waterway).

The method may include the steps of isolating the fluid volume within the bilge. Such isolating may include positioning a sidewall within the bilge and/or positioning a floating petrochemical absorber relative to the sidewall. Further, use of such a petrochemical absorber may include moving the petrochemical absorber relative to the sidewall as a function of the level of fluid within the bilge. Positioning the inlet of the fluid conduit may include positioning the inlet at a predetermined height above a bottom surface of the bilge. The method may further include initiating operation of the pump when the fluid level reaches a maximum desired fluid height. Such pumping may be terminated upon fluid level reaching a minimum desired fluid height. In one arrangement, this minimum desired fluid height may be above the height of the inlet (e.g., as measured from a bottom surface of the bilge). In this regard, the inlet may be isolated from floating petrochemicals by being maintained within bilge fluid at a location beneath the floating petrochemicals.

DETAILED DESCRIPTION

Reference will now be made to the accompanying drawings, which at least assist in illustrating the various pertinent features of the present invention. In this regard, the following description is presented for purposes of illustration and description and is not intended to limit the invention to the form disclosed herein. Consequently, variations and modifications commensurate with the following teachings, and skill and knowledge of the relevant art, are within the scope of the present invention. The embodiments described herein are further intended to explain the best modes known of practicing the invention and to enable others skilled in the art to utilize the invention in such, or other embodiments and with various modifications required by the particular application (s) or use(s) of the present invention.

Figure 1:
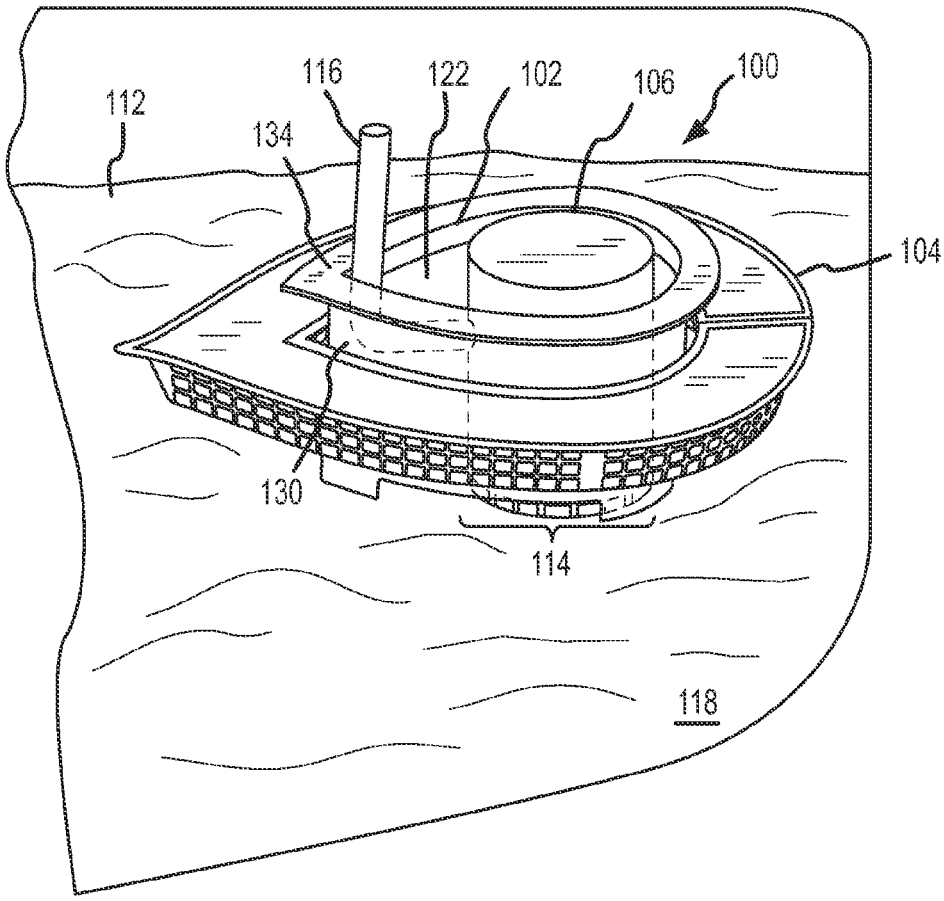
FIG. 1 illustrates a perspective view of one embodiment of a water pollution prevention apparatus.

Shown in FIG. 1 is one embodiment of a water pollution prevention apparatus 100 for use in a bilge 118 of a marine vessel. The apparatus 100 includes a locator/isolator 102 and an absorber 104, which floats on a surface of fluid 112 in the bilge 118 and which is disposed about a perimeter of the locator/isolator 102. The absorber 104 includes a petrochemical absorbing material that absorbs petrochemicals present within the fluid 112 in the bilge 118. The water pollution prevention apparatus 100 is designed for mounting directly within the bilge 118 and may be positioned anywhere therein, such as proximate to a bilge pump 106 to isolate the bilge pump 106 from receipt of petrochemicals. Alternatively, however, it will be appreciated from the following description that other mounting locations are possible and anticipated to achieve the objects and advantages of the present invention, namely preventing the discharge of petrochemicals from marine vessels and removal of the same from bilge areas, e.g., bilge 118.

The present embodiment of the apparatus functions as follows. Fluid 112 collects within the bilge 118 and may include petrochemicals, which float on the surface of the fluid 112. The combination of the locator/isolator 102 and the absorber 104 isolate a fluid volume in the bilge 118 from such petrochemicals. This allows fluid to be drawn from that volume substantially free of petrochemicals. In this regard, the sidewall 130 of the locator/isolator defines a vertically enclosed volume 122 in the fluid 112 and the absorber 104 defines an enclosed space on the surface of the fluid 112 between the sidewall 130 and the absorber 104. As shown, the sidewall 130 is positioned within the bilge 118 substantially perpendicular to a fluid line therein.

The absorber 104 includes a petrochemical absorbing material that absorbs petrochemicals floating on the surface of the fluid 112 to prevent entry of such petrochemicals into the enclosed space. The sidewall 130 of the locator/isolator 102 creates a barrier that prevents floating petrochemicals from entering the enclosed volume 122. Fluid beneath the floating petrochemicals enter the enclosed volume through openings near the base of the sidewall 130. As shown, the combination of the sidewall 130 acting as a barrier and the absorber 104 absorbing petrochemicals isolates the enclosed volume 122 from the receipt of petrochemicals even with changing fluid levels in the bilge 118. That is, as the level of the fluid 112 raises within the bilge 118, the absorber 104 floats up along the sidewall 130 of locator/isolator 102 with a level of the fluid 112. Likewise as the level of fluid 112 recedes, the absorber 104 floats down along the locator sidewall 130. In any case, as the level of fluid 112 changes the lateral position of the absorber 104 is maintained by the locator sidewall 130. Thus, the locator/isolator 102 defines a predetermined path of travel for the absorber 104 as a function of the level of fluid 112 in the bilge 118. Though discussed above as being utilized in combination, the locator/isolator 102 and/or absorber 104 may, in some instances, be utilized individually to prevent discharge of petrochemicals from the bilge 118, as will be more fully discussed herein.

Figure 2A:
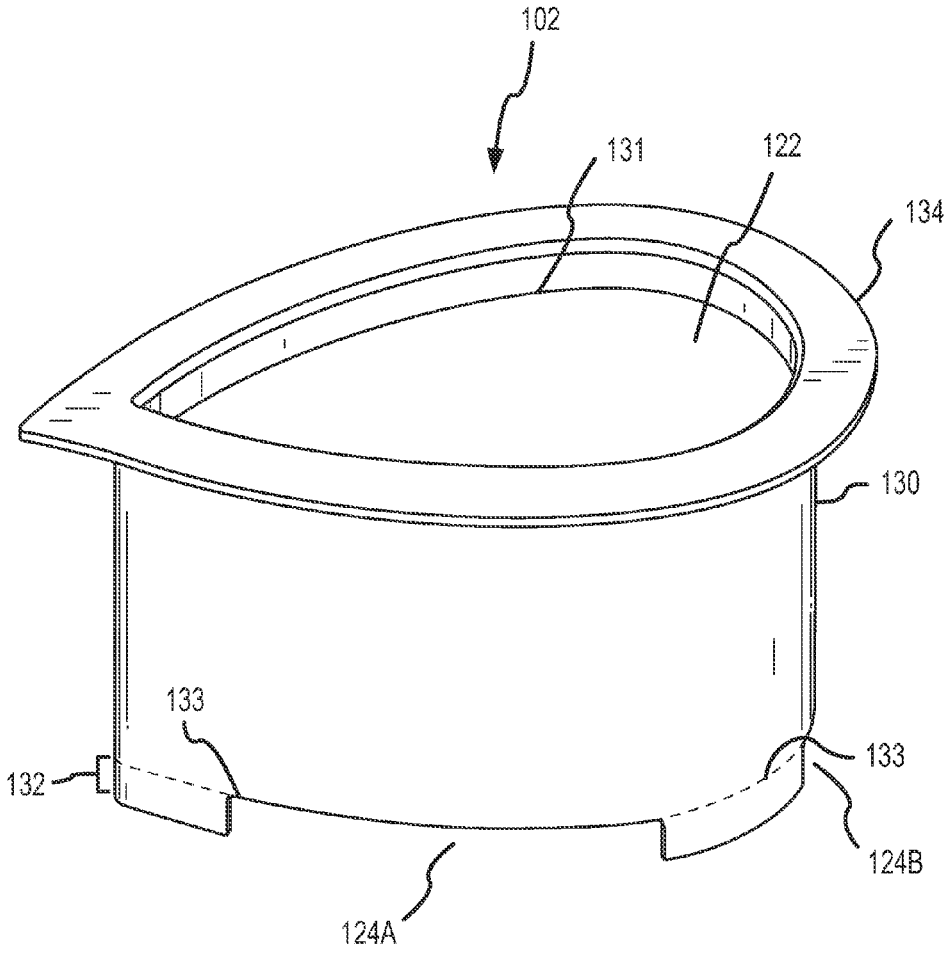
FIG. 2A illustrates a perspective view of one embodiment of a petrochemical isolator for use in a bilge of a marine vessel.

Referring now to FIG. 2A, a perspective view of the locator/isolator 102 of the water pollution prevention apparatus 100 is shown. As noted, the locator/isolator 102 includes a continuous sidewall 130, which defines the vertically enclosed volume 122 between a top sidewall edge 131 and a bottom sidewall edge 133, and which is configured to position an absorber 104 within a bilge 118 of a marine vessel. Extending through a non-continuous portion or base 132 of the sidewall 130 are openings 124A and 124B (collectively openings 124 unless specifically referenced) that allow fluid 112 to be introduced into the enclosed volume 122. That is, the openings 124 provide a passage way for bilge fluid 112 to enter the enclosed volume 122 for removal. Additionally, the locator/isolator 102 includes a lip 134 that limits vertical movement of the floating absorber 104 when positioned about the locator/isolator 102.

The openings 124 provide passageways for fluid in the bilge 118 to enter enclosed volume 122 and, in the present embodiment, be pumped out of the bilge 118 by the pump 106 disposed within enclosed volume 122. The openings 124 are located near the base 132 of the sidewall 130 so that fluid may be drawn from as low a point in bilge 118 as possible. The dimensions of openings 124 may vary depending on the particular bilge, bilge pump and/or absorber being used. Generally, the total area openings 124 will be at least as large as the combined area of a pump inlet disposed within the enclosed volume. Such sizing prevents restricting fluid flow to a bilge pump.

The height of openings 124 (i.e., as measured from the base 132) may be related to a thickness of the absorber 104. For instance, the maximum height of openings 124 may be no greater than a thickness of the absorber, or, the maximum height of openings 124 may be a fraction of the thickness of the absorber (e.g., not greater than one-half the thickness of the absorber). In such embodiments, the sidewall 130 prevents entry of petrochemicals into the enclosed volume 122 when the fluid level in the bilge is above the maximum height of the openings 124. Further, the absorber 104 may prevent entry of petrochemicals into the enclosed volume when a fluid level in the bilge 118 drops to a level lower than the maximum height of the openings 124. As will be appreciated, the locator/isolator 102 may alone prevent entry of petrochemicals into the enclosed volume if a minimum fluid level does not drop below a maximum height of the openings 124 (e.g., a bottom edge 133 of the sidewall 130).

The width of openings 124 may also be varied. For example, a first opening 124A may extend around a substantial portion of one-half the perimeter of base 132 while a second opening 124B may extend around a substantial portion of the other half of the perimeter of the base 132. Moreover, locator/isolator 102 is not limited to having two openings. For instance, the openings 124 may include multiple slots and/or apertures such that multiple openings define a screen sized to prevent entry of debris of a predetermined size into the enclosed volume 122.

Figure 2B:
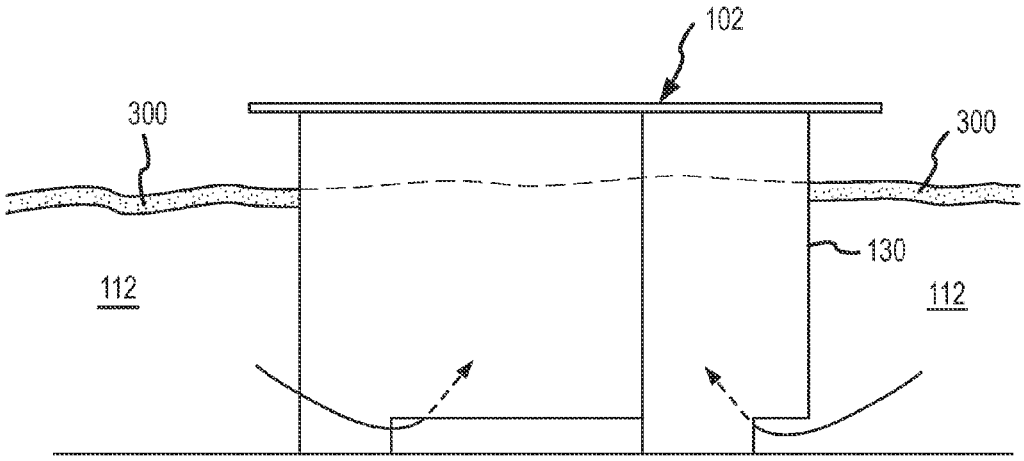
FIG. 2B illustrates a side view of one embodiment of a petrochemical isolator for use in a bilge of a marine vessel.

As illustrated in FIG. 2B, the sidewall 130 above the openings 124 is continuous about its periphery (e.g., a solid wall). Accordingly, one advantage of this continuous sidewall 130 is that it provides a barrier to petrochemicals 300 floating on the surface of bilge fluid 112 when the bilge fluid level is above a height of the openings 124 (i.e., as measured from the base). Accordingly, this prevents a fluid port (e.g., of a pump) disposed within the enclosed volume 122 from receiving petrochemicals 300 floating on a surface of the fluid 112 outside of the sidewall 130. That is, the surface of the fluid 112, and all of the fluid within the sidewall 130 is substantially free of petrochemicals 300.

As noted, the lip 134 is designed to limit vertical movement of the floating absorber 104. As shown in FIG. 1, the lip 134 extends outwardly from the sidewall 130 to prevent the absorber 104 from rising beyond a height of the lip 134. If the level of liquid rises above a height of the sidewall 130, the lip 134 will prevent the absorber 104 from floating above the sidewall 130, where it would no longer be maintained in the predetermined lateral position by the sidewall 130. Accordingly, the lip 134 should extend far enough away from enclosed volume 122, so that it will contact and hold the inner perimeter of the absorber 104.

The lip 134 need not extend completely around a perimeter defined by the sidewall 130. As will be appreciated, only a small portion of the lip 134 is necessary to prevent the absorber 104 from rising above the sidewall 130. Thus, in some embodiments, the lip 122 may only extend over only a portion of the periphery defined of the sidewall 134. Additionally, in other embodiments the lip 134 may be segmented including several separate pieces disposed about the periphery of the sidewall 130. That is, the lip 134 may be discontinuous and include a plurality of lips.

In the present embodiment, the lip 134 is removably connected to the sidewall 130. This allows for removing the absorber 102 when it has reached its limit for absorbing petrochemicals. To facilitate removable connection, a base portion of the lip 134 includes a channel (not shown) made from a flexible material that accommodates the top edge of the sidewall 134. The channel may be sized slightly smaller than the top edge of the sidewall to provide a frictional fit. The lip 134 may then be easily removed and reconnected to the sidewall 130. In other embodiments, the lip 134 may include other removable fastening structures that facilitate the selective removal of the lip 134. Some non-limiting examples of such fasteners include screws, bolts, nuts, clips, hook and loop fasteners and combinations thereof. In other embodiments, the lip 134 may be permanently attached to the sidewall 130, such as may be the case when lip 134 is molded as a unitary piece with the sidewall 130. In these embodiments, the absorber 104 may be designed to accommodate its removal from around the locator/isolator 102 for replacement purposes.

The locator/isolator 102, its sidewall 130 and the lip 134 may be made of any appropriate material with properties that allow it to withstand the conditions within a bilge and still maintain its structural integrity. Of particular importance in selecting a suitable material is a material's resistance to the corrosive effects of the variety of liquids found in a bilge, including water and petrochemicals. Some examples of materials that may be used in the sidewall 130 include polymers (e.g., plastics), ceramics, metals and combinations thereof. the overall size of the apparatus 100. However, the shape of the enclosed volume 122 defined by the sidewall 130 is not limited to any particular shape. In other embodiments, the cross-sectional area of the sidewall 130 may have any of a number of different shapes including, without limitation, circular, regular polygonal shapes and/or irregular shapes.

In the present embodiment, a bilge pump 106 is positionable within the sidewall 130 of the locator/isolator 102. See FIG. 1. Accordingly, the enclosed volume 122 defined by the sidewall 130 is sized to accommodate a particular bilge pump that will be positioned therein. Positioning the bilge pump 106 within the sidewall 130 substantially isolates fluid inlets 114 of the pump 106 from receipt of petrochemicals thereby allowing the pump 106 to pump fluid out of the bilge 118 substantially free of petrochemicals. It will be appreciated that the locator/isolator 102 is not limited to use with a particular bilge pump 106, but is useful with any one of numerous types of bilge pump systems utilized in marine vessels. For purposes of illustration, however, the bilge pump 106 shown in FIG. 1 includes components that are typically in submersible bilge pump systems. In this regard, the bilge pump 106 includes inlets 114 disposed around its base, as well as an outlet conduit 116, connected to a location external to the bilge 118. During operation of the pump 106, fluid 112 within bilge 118 is drawn into the inlets 114 and discharged overboard of the vessel through the outlet conduit 116. It will be appreciated that in a typical bilge pump system, it may be desirable to locate the inlets 114 at the lowest practical point within the bilge 118 to facilitate removal of a maximum amount of fluid 112 during operation of the pump 106.

An automatic switch, not shown, controls operation of the pump 106 The switch functions to start and stop the pump 106 according to a level of fluid 112 contained within the bilge 118. The switch is electrically connected to the pump 106 such that as the fluid 112 accumulates in the bilge 118, an electrical contact is established, e.g., a float floats upward with the fluid 112 until the float switch is triggered to actuate operation of the pump 106. The pump 106 begins pumping the fluid 112 overboard through outlet conduit 116, which extends between the bilge pump 106 and an exit orifice located external to the marine vessel. Similarly, as fluid 112 is pumped overboard and the level of the fluid 112 recedes, the electrical contact is terminated, e.g., a float moves down with the level of fluid 112 and terminates operation of the pump 106. In the present embodiment, the float switch may be set to actuate operation of the pump 106 at a level near or just below the top edge 131 of the sidewall 130 and terminate operation of the pump 106 at a level above the bottom edge 133 of the sidewall 130. Other activation switches may also be utilized including, for example, contact switches which are activated when two or more electrical contact points are interconnected by fluid in the bilge 118.

Figure 3:
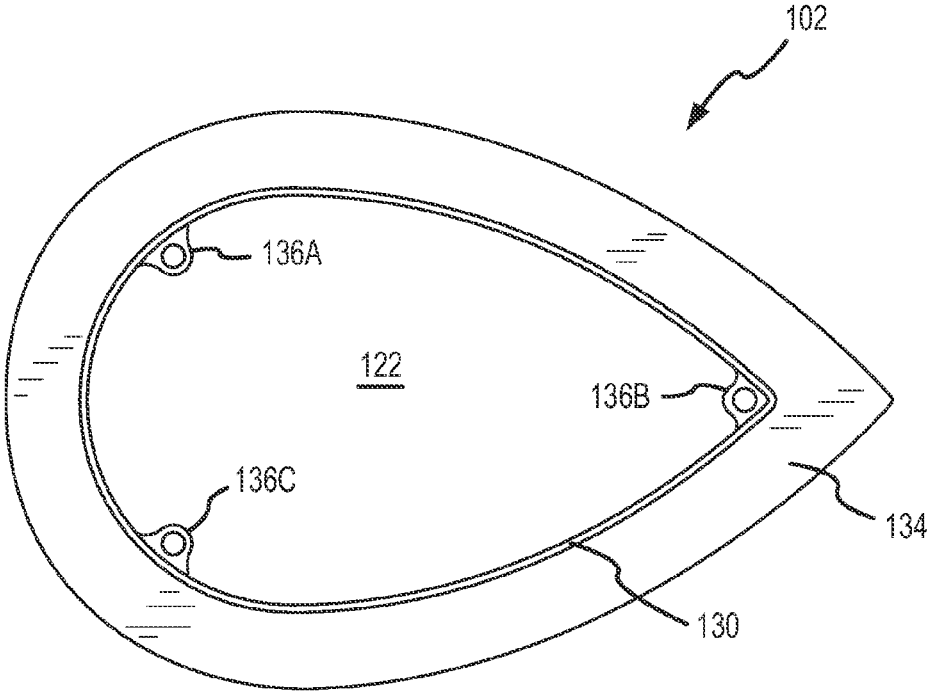
FIG. 3 illustrates a top view of the isolator shown in FIG. 2.
Figure 4A:
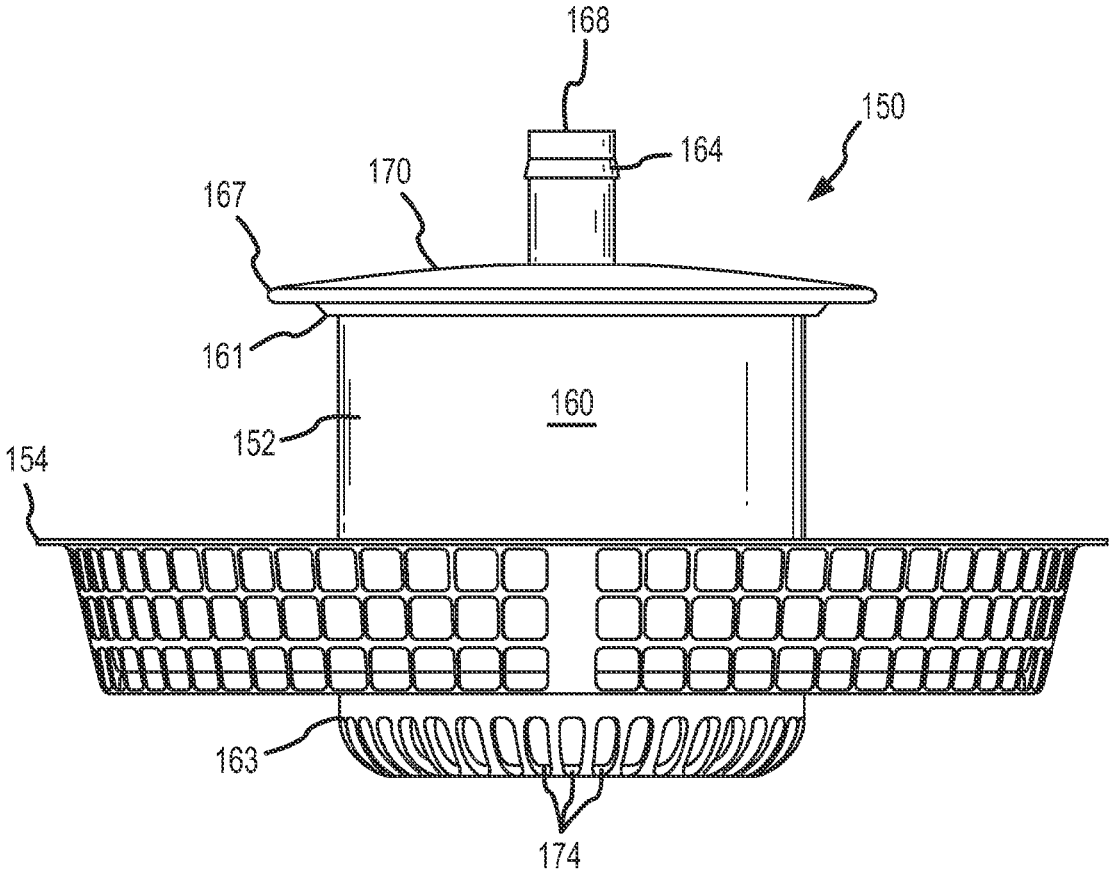
FIG. 4A illustrates a side view of a second embodiment of a petrochemical isolator for use in a bilge of a marine vessel.
Figure 4B:
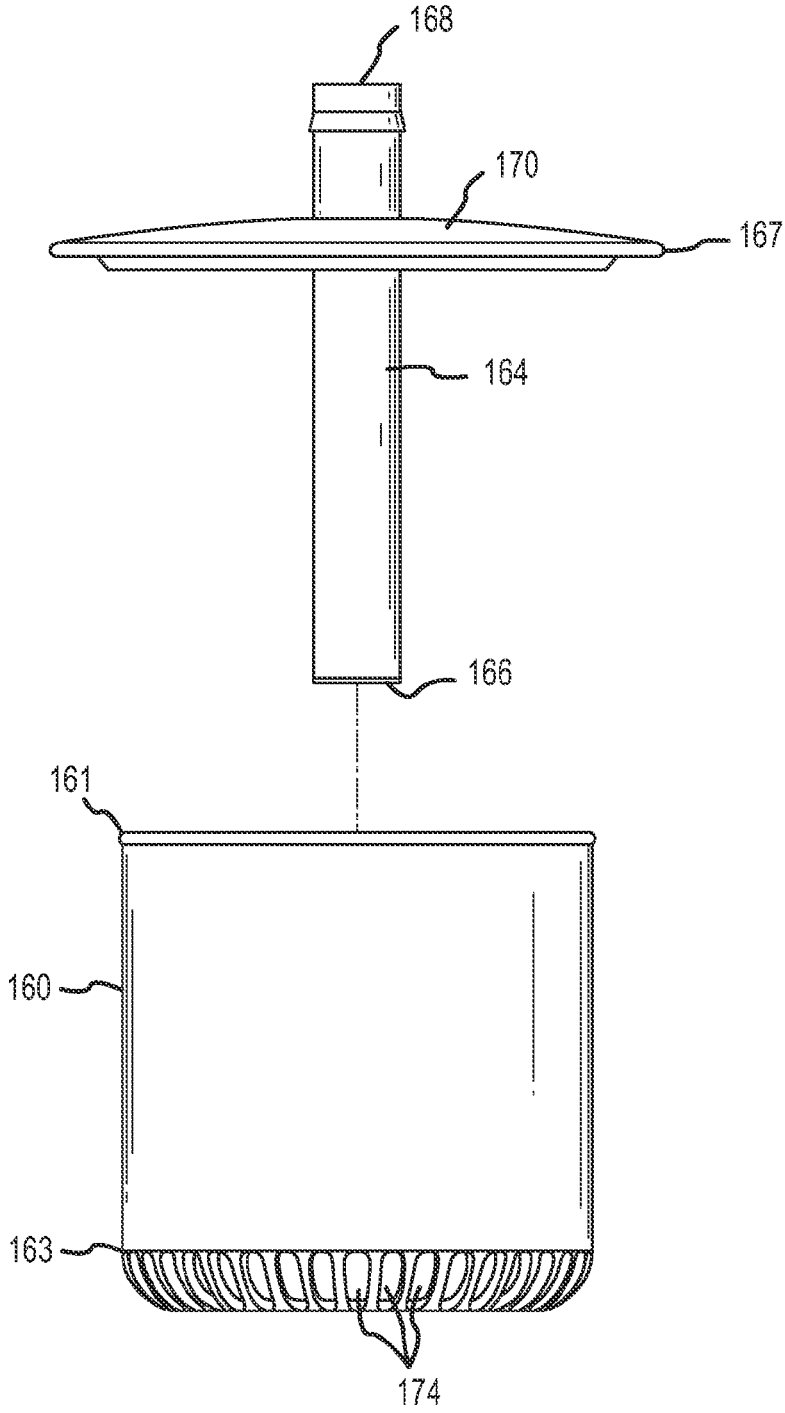
FIG. 4B illustrates an exploded side view of the embodiment of FIG. 4A.
Figure 5:
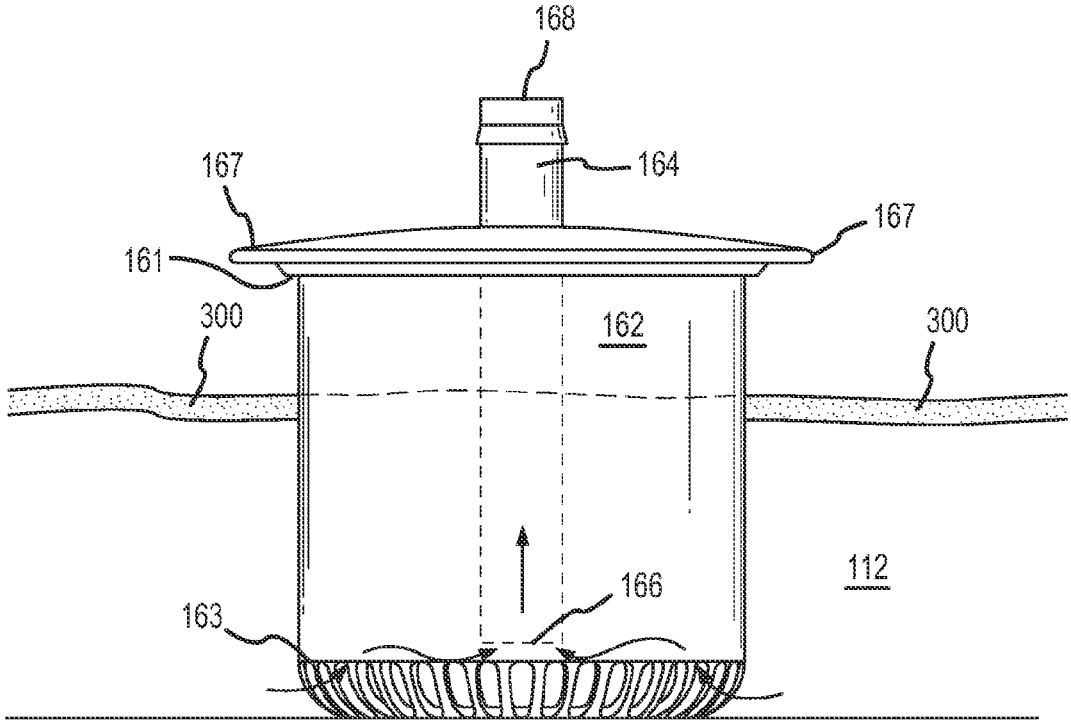
FIG. 5 illustrates a side view of the petrochemical isolator of FIG. 4A.

FIGS. 4A, 4B and 5 illustrate a second embodiment of a water pollution prevention apparatus 150 for use in a bilge of a marine vessel. As shown, the apparatus 150 includes a locator/isolator 152 that is adapted to position an absorber 154 that floats on a surface of a fluid 112 in the bilge 118. As shown, the absorber 154 is disposed about a perimeter of the locator/isolator 152. In this regard, the locator/isolator 152 includes a continuous sidewall 160 that defines a vertically enclosed fluid volume 162. However, in contrast to the apparatus 100 discussed in relation to FIGS. 1-3, the present apparatus 150 does not house a pump within the enclosed volume 162. Rather, the present apparatus 150 is utilized to position a fluid conduit 164 within the enclosed volume 162.

The locator/isolator 152 and floating absorber 154 operate in a manner substantially identical to the locator/isolator 102 and floating absorber 104 discussed in relation to FIGS. 1-3. That is, the floating absorber 154 absorbs petrochemicals floating on bilge fluid and is operative to move up and down with changes of the level of the bilge fluid. Likewise, the sidewall 160 of the locator/isolator 152 is adapted to maintain a lateral position of the floating absorber 154 and provides a physical barrier to entry of petrochemicals into an enclosed volume defined by the sidewall. Also, the locator/isolator 152 includes a lip 167 that extends outwardly from the upper end of the sidewall 160. This lip 167 limits vertical movement of the absorber 154 along the sidewall 160.

Referring to the view of FIG. 4B, a cap member 170 is shown. The cap member extends over the top surface of the locator/isolator 152 to provide a continuous cover over the top edge of the sidewall 160. In this regard, the lip 167 is integrated onto the periphery of the cap member 170. In addition, use of a continuous cap member prevents petrochemicals floating on bilge fluid 118 from entering into the enclosed volume 162 over the top edge of the sidewall 160. Further, the cap member 170 allows for positioning the fluid conduit 164 at a desired location within the enclosed volume 162. That is, the cap member 170 acts as a locator for positioning the fluid conduit 164. The cap member 170 supports the conduit relative to the enclosed volume such that an inlet port 166 of the fluid conduit 164 may be disposed at a location spaced from the sidewall 160. This may prevent creation of an area of high suction that may draw petrochemicals beneath the sidewall 160 and/or the floating absorber 154.

As shown, the fluid conduit extends into the enclosed volume 162 such that an inlet end/port 166 is operative to draw fluid from the enclosed volume 162. A second end of the fluid conduit 164 extends outside of the enclosed volume 162. This second end/outlet port 168 may be interconnected to a bilge pump using, for example, a flexible hose extending therebetween.

As shown, a plurality of openings 174 is disposed about a perimeter of the base of the sidewall 160. These openings 174 are sized to prevent passage of debris of a predetermined size into the enclosed volume 162. Stated otherwise, the plurality of openings 174 form a strainer or screen that permits fluid into the enclosed volume 162 while preventing debris from entering the enclosed volume 162 and, hence, being drawn into the inlet port 166 of the fluid conduit 164. Though shown as a plurality of equally spaced slots, it will be appreciated that the openings 174 may include any appropriate openings (e.g., circular holes) having a predetermined maximum size. What is important is that the openings 174 provide an open area that is preferably larger than the area of the inlet port 166 of the fluid conduit 164 while preventing the entry of debris into the enclosed volume 162. As discussed above, it may be preferable that the openings 174 do not extend above a predetermined height along the sidewall 160 (e.g., bottom edge 163) of the locator/isolator 152 such that the sidewall 160 above the openings 174 forms a continuous barrier.

Figure 6:
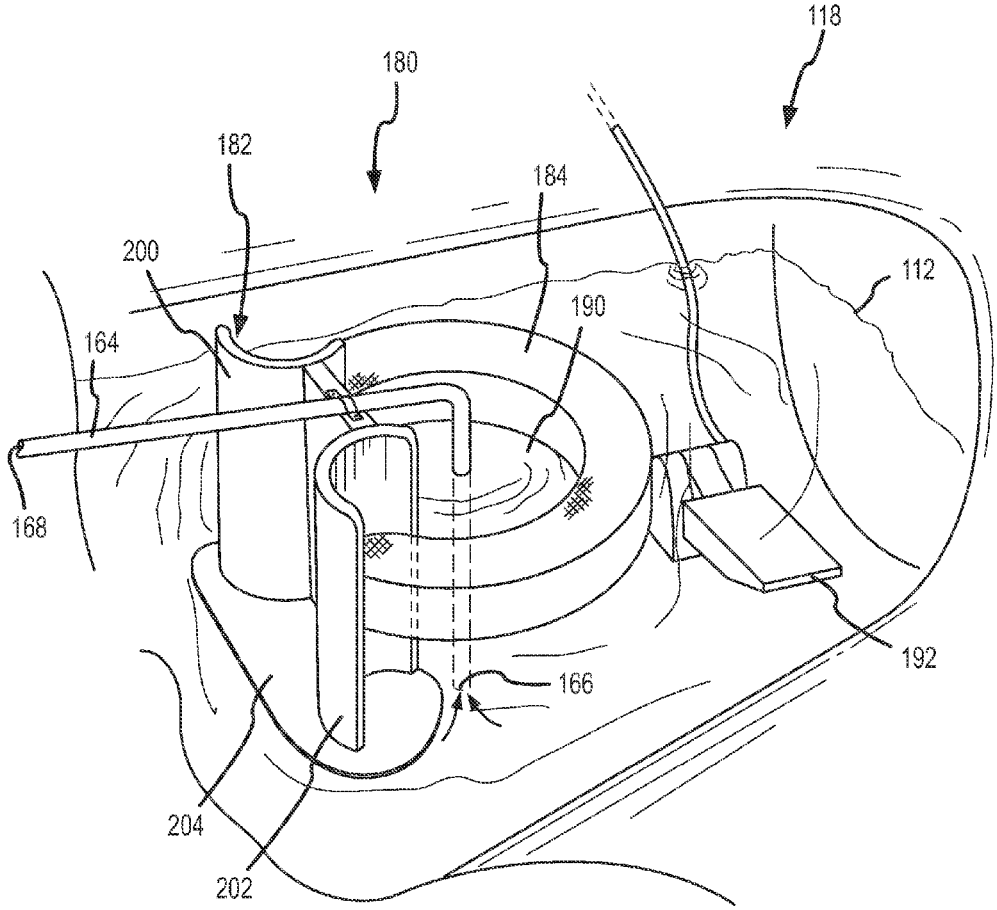
FIG. 6 illustrates a perspective view of a third embodiment of a petrochemical isolator for use in a bilge of a marine vessel.

Though discussed as being used in conjunction with the floating absorber 154, the locator/isolator 152 may be configured for use without the absorber 154 in such a manner that it still provides an effective barrier for removal of petrochemicals from the bilge 118. FIG. 6 shows a cross sectional view of the apparatus 150 that extends through the fluid conduit 164. As shown, inlet end/port 166 of the fluid conduit 164 is positioned within the interior volume at a location above the maximum height of the openings 174 (i.e., as measured from a base 172). As shown, such an arrangement prevents lowering the bilge fluid level to a level beneath the maximum height of the openings. In this regard, petrochemicals 300 floating on the surface of the fluid 112 (i.e., at a location above the maximum height of the sidewall openings 174 are prevented from entering into the interior volume 162. That is, this arrangement provides a physical barrier to the removal of petrochemicals 300 from the bilge in the absence of a petrochemical absorber 154. Accordingly, fluid may be drawn from the interior volume 162 substantially free of petrochemicals 300 until the level of the fluid 112 is lowered to the bottom end/inlet port 166 of the fluid conduit 164. As will be appreciated, the operation of a bilge pump may also be set to maintain a fluid level above the maximum height of the sidewall openings 174.

In one arrangement, the fluid conduit 164 may be adjustable such that the position of the inlet port 166 is adjustable relative to the sidewall 160 and its sidewall openings 174 and/or to the bilge floor surface. In such an embodiment, the inlet of the conduit 164 may be lowered beneath the height of the sidewall openings 174 in order to maximize removal of fluid from the bilge 118.

It should be noted that the foregoing description of the various embodiments of locators/isolators 102 and 152 is merely for purposes of illustration. As stated above with respect to FIGS. 1-5, the locator/isolator 102 and 152 function to maintain a predetermined lateral position of an absorber within a bilge while providing a physical barrier to floating petrochemicals. However, the locator/isolator 102 and 152 is not limited to the structure disclosed and discussed above with respect to FIGS. 1-5. For instance, in other embodiments the sidewall of the isolator/locator may be discontinuous and include breaks, spaces or gaps, such as may be the case when the sidewall is made of several pieces or of non-continuous pieces. In the case of a non-continuous sidewall, the function of the sidewall may be limited to positioning (i.e., locating) the absorber. That is, the sidewall of the locator may not alone provide a physical barrier to the receipt of floating petrochemicals and may require the use of one or more absorbers for petrochemical isolation purposes. For example, in a very simple embodiment, a locator may merely be an elongated member (e.g., a rod) that is positioned vertically in relation to the surface of fluid in the bilge. The elongated member may fit into a corresponding channel in an annular absorber to maintain a lateral position of the absorber. In another embodiment, the locator may include a plurality of elongated members (e.g., rods) positioned vertically in relation to the surface of fluid in a bilge and which fit into one or more aperture through an absorber (e.g., an enclosed space of defined by an annular absorber) to maintain the absorber in a predetermined lateral position.

FIG. 6 illustrates an embodiment of a water pollution prevention apparatus that utilizes a non-continuous sidewall. Again, the water pollution prevention apparatus 180 includes a locator 182 and an absorber 184. However, in this embodiment, the locator 182 does not include a continuous sidewall that forms a barrier to the entry of petrochemicals. Rather, the locator 182 and absorber 184 collectively define an enclosed surface area 190 in the fluid 112 that is free of petrochemicals. As shown, the locator is further operable to position and support a fluid conduit 164, which may extend to a location vertically below the enclosed surface area 190. This allows an inlet 166 of the fluid conduit 164 to draw fluid from the bilge 118 free of petrochemicals. The height of the inlet 166 may be adjusted to, for example, maximize the removal of fluid from the bilge 118. An outlet 168 of the fluid conduit 164 may be interconnected to an inlet of a bilge pump (not shown). In this regard, the water pollution prevention apparatus of FIG. 6 and other embodiments that support an inlet of a fluid conduit in fluid area and/or volume that is free of petrochemicals may be advantageously utilized with bilge pumps that are removed from the bilge fluid and/or the bilge 118.

The locator 182 includes a pair of housings, 200 and 202. The housings, 200 and 202, are connected in parallel relation to each other and perpendicular relation to a base member 204. The base member 204 is in turn, mountable within the bilge 118. The housings, 200 and 202, are generally upstanding relative to the base member 204 such that when the base member 204 is mounted in the bilge 118, the housings, 200 and 202, are in a substantially perpendicular relation to the surface of the fluid 112. This in turn controls the direction and facilitates movement of the absorber 184 as a function of the level of fluid 112 in the bilge 118. The housings, 200 and 202, each include or define locator channels that function as an interface for slidable connection with first and second ends of the absorber 184.

As discussed above in relation to the embodiments of FIGS. 1-5, the locator 182 of FIG. 6 operates to position the absorber 184 within the bilge 118 as the level of fluid 112 moves up and down between pumping cycles as may be controlled by float switch 192. Specifically, as the fluid 112 moves up within the bilge 118 the absorber 184 is floated up along the locator 182 with the fluid 112. Likewise as the level of fluid 112 drops, the absorber 184 moves down the locator 182 with the level of fluid 112. Further, the absorber 184 and locator 182 define the enclosed surface area 190, which is substantially free from petrochemicals. To maintain the enclosed area free of petrochemicals, the absorber 184 preferably comprises a material that absorbs petrochemicals from the fluid 112, such that petrochemicals are unable to pass under or through the absorber 184. This in turn maintains the area 190 substantially free from petrochemicals; thereby isolating the inlet 166 of the fluid conduit 164 from receipt of petrochemicals.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

The invention claimed is:

1. An apparatus for use in a system for removing fluid from a bilge of a marine vessel substantially free of petrochemicals, comprising:

a base member for attachment to a surface of a bilge a continuous sidewall interconnected to the base member and defining a vertically enclosed volume between a top edge and a bottom edge, the sidewall forming a barrier to petrochemicals floating on a fluid surface when the fluid surface is between the top edge and the bottom edge of the sidewall; and a plurality of openings between the base member and the bottom edge of the sidewall, the plurality of openings permitting fluid to be introduced into the enclosed volume from beneath a fluid surface when the fluid surface is between the top edge and the bottom edge of the sidewall.

2. The apparatus of claim 1, further comprising:

a floating petrochemical absorber disposed about at least a portion of the sidewall.

3. The apparatus of claim 2, wherein a thickness of the petrochemical absorber is greater than a maximum height of said at least one opening as measured from the base.

4. The apparatus of claim 2, wherein the absorber defines an enclosed area, wherein the enclosed area is sized to encircle the continuous sidewall.

5. The apparatus of claim 1, wherein the enclosed volume is sized to receive at least a portion of a bilge pump.

6. The apparatus of claim 1, further comprising:

a lip interconnected to at least a portion of the sidewall and extending outwardly relative to the vertically enclosed volume, wherein the lip is operative to limit upward movement of a floating petrochemical absorber disposable about at least a portion of the sidewall.

7. The apparatus of claim 6, wherein the lip is removably connectable to the sidewall.

8. The apparatus of claim 1, wherein each of the plurality of openings is sized to prevent debris of a predetermined size from entering into the enclosed volume.

9. The apparatus of claim 1, wherein an outside surface of the sidewall between the top edge and the bottom edge is substantially vertical about a periphery of the sidewall relative to the base, wherein the vertical outside surface permits a floating absorber disposable about at least a portion of the sidewall to move relative to the sidewall as a function of a level of liquid within the bilge.

10. The apparatus of claim 1, wherein the base member comprises at least one mounting bracket connected to the sidewall.

11. The apparatus of claim 1, wherein the base member further comprises:

a plate member having at least a first portion disposed substantially perpendicular to the sidewall.

12. The apparatus of claim 1, further comprising:

a cap member disposed over at least a portion of an area defined by the sidewall.

13. An apparatus for use in a system for removing fluid from a bilge of a marine vessel substantially free of petrochemicals, comprising:

a base for attachment relative to a bottom surface of a bilge;

a continuous sidewall extending upward from the base and defining an enclosed area, the sidewall having a solid peripheral section between a first sidewall height as measured from the base and a second sidewall height as measured from the base, wherein the second sidewall height is greater than the first sidewall height; and at least one opening extending through the sidewall at a location between the base and the first sidewall height, the at least one opening being operative to permit fluid into the enclosed area defined by the sidewall.

14. The apparatus of claim 13, wherein the sidewall defines a barrier between the first sidewall height and the second sidewall height to petrochemicals floating on a fluid surface when the fluid surface is between the first and second sidewall heights.

15. The apparatus of claim 13, wherein the enclosed area is sized to receive a bilge pump.

16. The apparatus of claim 13, further comprising:

a floating petrochemical absorber disposable about at least a portion of the sidewall.

17. The apparatus of claim 16, further comprising:

a lip interconnected to at least a portion of the sidewall and extending outwardly relative to the enclosed area.

18. The apparatus of claim 16, wherein a thickness of the petrochemical absorber is greater than a maximum height of said at least one opening as measured from the base.

19. The apparatus of claim 13, further comprising:

a plurality of openings extending through the sidewall at a location between the base and the first sidewall height.

20. The apparatus of claim 19, wherein each the plurality of openings is sized to prevent debris of a predetermined size from entering into the area defined by the sidewall.

21. A method for removing fluid from a bilge of a marine vessel substantially free of petrochemicals, comprising:

disposing a continuous sidewall within a bilge, the sidewall defining a vertically enclosed volume within the bilge;

drawing fluid into the vertically enclosed volume though an opening in the sidewall disposed below a minimum fluid height in the bilge;

absorbing petrochemicals floating on a surface of fluid within the bilge proximate to an outside periphery of the sidewall using a petrochemical absorber that moves relative to the sidewall as a function of the level of fluid in the bilge;

maintaining a lateral position of the petrochemical absorber with an outside surface of the sidewall; and removing fluid from within the vertically enclosed volume, wherein the fluid is removed from the bilge.

22. The method of claim 21, further comprising:

positioning a portion of the sidewall above a maximum desired fluid height in the bilge.

23. The method of claim 22, further comprising:

initiating operation of a pump when a fluid level reaches the maximum desired fluid height, wherein the pump removes water from the vertically enclosed volume.

24. The method of claim 23, further comprising:

deactivating the pump when the water level reaches the minimum fluid height.

25. The method of claim 21, further comprising limiting vertical movement of the petrochemical absorber with a lip extending outwardly from at least a portion of the sidewall.

26. The method of claim 21, futher comprising:

disposing a bilge pump within the vertically enclosed volume , wherein the pump is operative to pump fluid of the volume.

* * * * *

UNITED STATES PATENT AND TRADEMARK OFFICE

CERTIFICATE OF CORRECTION

PATENT NO. : 7,468,128 B2
APPLICATION NO. : 11/305680
DATED : December 23, 2008
INVENTOR(S) : Clukies It is certified that error appears in the above-identified patent and that said Letters Patent is hereby corrected as shown below:

Column 14, line 63, delete “though” and insert therefor --through--.
Column 16, line 4, after “comprising”, insert therefor --:--.
Column 16, line 8, delete “futher” and insert therefor --further--.

Signed and Sealed this

Seventeenth Day of February, 2009

JOHN DOLL
*Acting Director of the United States Patent and Trademark Office*